United States Patent [19]

Schade

[11] 3,983,443

[45] Sept. 28, 1976

[54] VACUUM ELECTRON DEVICE HAVING DIRECTLY-HEATED MATRIX-CATHODE-HEATER ASSEMBLY

[75] Inventor: Horst Ernst Paul Schade, Blawenburg, N.J.

[73] Assignee: RCA Corporation, New York, N.Y.

[22] Filed: Mar. 24, 1975

[21] Appl. No.: 561,440

[52] U.S. Cl. ..... 313/341; 313/346 R; 313/346 DC; 313/39; 313/46; 313/446

[51] Int. Cl.[2] ..... H01J 1/15; H01J 17/08; H01K 1/02

[58] Field of Search ..... 313/346, 346 DC, 341, 313/46, 39, 446, 447, 448

[56] References Cited

UNITED STATES PATENTS

| | | | |
|---|---|---|---|
| 3,263,115 | 7/1966 | Glascock, Jr. et al. | 313/346 DC |
| 3,440,475 | 4/1969 | Schiller et al. | 313/346 |
| 3,633,062 | 1/1972 | Tamura | 313/346 |

*Primary Examiner*—Saxfield Chatmon, Jr.
*Attorney, Agent, or Firm*—G. H. Bruestle; L. Greenspan

[57] ABSTRACT

Device comprises an evacuated envelope and a heater-cathode assembly including an electrically-conductive, porous metal body containing electron-emission material and at least two electrically-resistive legs attached directly to spaced positions on the body. Electric current flowing through the legs and body generates heat in the legs, which heat is thermally conducted to the body. The parts are proportioned to reduce radiation losses by minimizing surface area. The structure reduces bulk and mass to permit short heating-up times.

10 Claims, 5 Drawing Figures

VACUUM ELECTRON DEVICE HAVING DIRECTLY-HEATED MATRIX-CATHODE-HEATER ASSEMBLY

BACKGROUND OF THE INVENTION

This invention relates to a novel vacuum electron device having a directly-heated matrix-cathode assembly.

A vacuum electron divice is generally comprised of an evacuated envelope and means for producing an electron emission within the envelope. One such means, referred to as a matrix or dispenser cathode, comprises a porous body or matrix of refractory metal having electron-emission material in the pores of the body. In previous assemblies, the body is supported on or in a refractory member, usually a metal sheath or container. The support member is heated to its operating temperature either indirectly by an electric current passing through a separate heater, as shown, for example in U.S. Pat. No. 3,760,218, to L. J. Cronin; or directly by an electric current passing through the support member, as shown for example, in U.S. Pat. No. 3,758,808 to W. Held et al. In U.S. Pat. No. 3,263,115 to H. H. Glascock et al, legs are attached to the support member, and the electric current passes through and heats the legs, the support member and the body. In Glascock et al, the legs, which heat the support member by conduction and radiation, are shaped to confine heat to the support member.

Such previous assemblies are bulky so that an assembly may not conveniently fit within a commercial-type television-picture tube. Due to the mass and the total radiating surface of the previous assemblies, the power efficiencies of the assemblies are less than may be desired. The power consumption may be too high to be practical for use in present-day television picture tubes. Such previous assemblies are relatively massive so that their rate of heating-up is too slow to be acceptable for use in many tube types.

SUMMARY OF THE INVENTION

The novel vacuum electron device employs a heater-cathode assembly comprising a porous, electrically-conductive body having emission material stored in the pores of the body. At least two electrically-resistive legs are connected directly to spaced positions on the body, and thereby define the ends of the electric current path through the body and also mechanical support therefor. Means for applying an electric voltage are connected to the legs. When a voltage is applied, an electric current passes through the body and legs, thereby heating the legs by joule heating. Heat generated in the legs then passes by thermal conduction to the body and heats the body to its operating temperature.

In order to drop most of the applied voltage across the legs and only an insignificant portion of the voltage across the body, the circuit resistance of the body is preferably made much less than that of the legs. For example, this is accomplished by making the electric-current-carrying cross sections of the legs small as compared to those of the body, and the length of the current paths in the legs long as compared to the path length in the body. In order to reduce radiative losses, the legs are preferably chosen to have circular or near-circular cross sections, and the body is preferably chosen to have a substantially cylindrical, or spherical shape, or a shape that is intermediate therebetween.

By connecting the body directly to the current-conducting legs, by eliminating passive components such as shields, containers, sheaths, and supports, and by reducing the surface area of the body and legs relative to their volume, both the bulk and the mass of the assembly are reduced substantially. This permits small-sized, fast warm-up cathode-heater assemblies to be provided, which are suitable for use in commercial television picture tubes. The reduction of bulk and mass, however, does not result in a reduction in the amount of electron-emission material stored in the body. Thus, the novel electron device is power efficient and exhibits a fast warm-up characteristic with no compromise in the life of the cathode.

DETAILED DESCRIPTION OF THE PREFERRED EMBODIMENT

Figure 1:
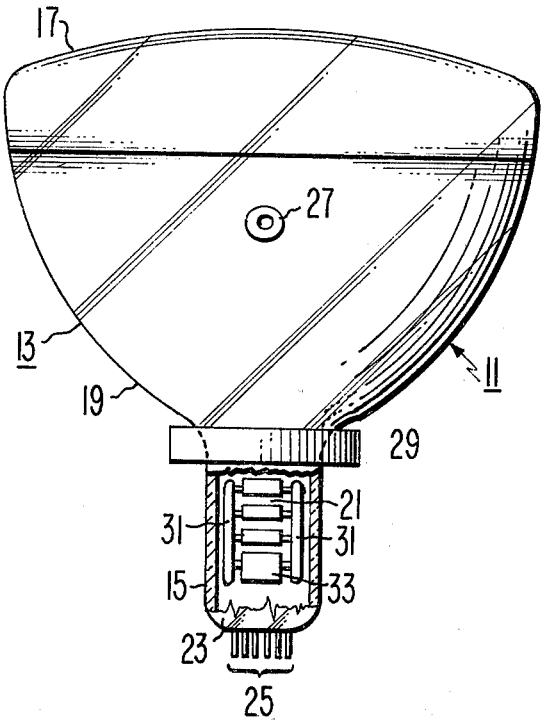
FIG. 1 is a partially-broken elevation of a novel cathode-ray tube incorporating a directly-heated heater cathode assembly.

In FIG. 1, a cathode-ray tube 11 comprises an envelope 13 including a neck 15, a faceplate panel 17 and an interconnecting funnel 19. An electron gun 21 in the neck 15 is adapted to project an electron beam toward the panel 17. The neck 15 is closed at one end by a stem structure 23 through which a plurality of leads 25 is sealed. Suitable operating voltages are supplied to the electron gun 21 through the leads 25. A conductive coating (not shown) is provided on the internal surface of the funnel 19. The conductive coating is connected to an anode button 27 to which a suitable high voltage may be supplied during the operation of the tube 11. A luminescent screen (not shown) on the internal surface of the panel 17 comprises one or more layers of particles which are adapted to luminesce in one or more colors when excited by the electron beam from the gun 21. A magnetic-deflection yoke 29 is positioned adjacent the juncture between the neck 15 and the funnel 19 for deflecting the electron beam to scan a raster over the screen. Except for the heater-cathode assembly of the electron gun 21, the tube 11 may be constructed and operated as in the prior art.

Figure 2:
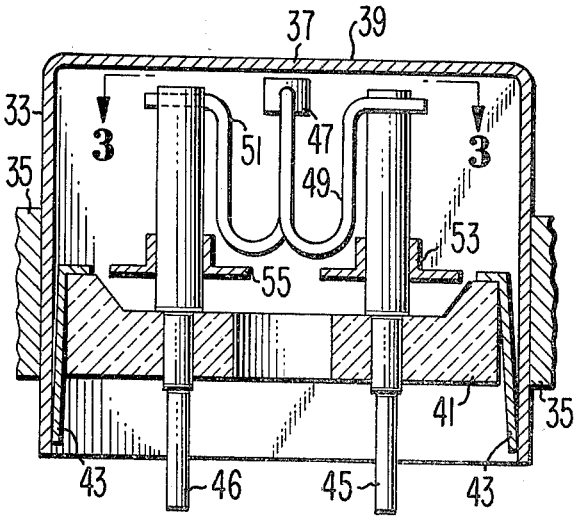
FIG. 2 is a sectional elevation of the heater-cathode assembly employed in the tubes shown in FIG. 1.

The electron gun 21 includes several electrodes or grids supported on glass beads 31 including a first grid 33 nearest the stem 23. The first grid 33, shown in detail in FIG. 2, is generally cup shaped with the open end facing the stem 23. The first grid 33 has two spacers 35 welded to opposite outer sides thereof for implantation into the glass beads 31, and a carefully-sized and shaped aperture 37 in the center of the closed end wall 39.

Figure 3:
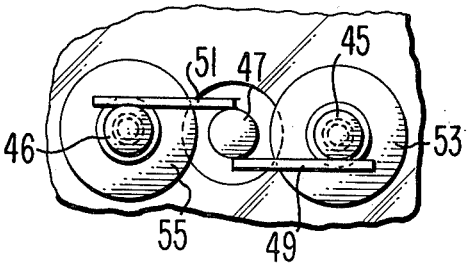
FIG. 3 is a plan view from section lines 3—3 of FIG. 2.

The first grid 33 contains the heater-cathode assembly, shown in detail in FIGS. 2 and 3, comprising an electrically-insulating ceramic base 41 supported from the inner wall of the grid 33 by three straps 43. Two studs 44 and 46 extend through and are sealed in the base 41 and support a matrix-cathode body 47 opposite the grid aperture 37 through heater legs 49 and 51.

The matrix-cathode body 47 is a commercially-available body; for example, a Type M cathode marketed by North American Philips Co., New York, N. Y., which comprises a porous refractory metal body (e.g., a tungsten metal body) of cylindrical shape about 44 mils (1.12 mm) in diameter and 35 mils (0.89 mm) high. Other matrix-cathode bodies may be used. The body 47 contains electron-emission material, such as barium aluminate, in the pores thereof. The heater legs 49 and 51 are 7-mil (0.18 mm) diameter round tantalum wire about 400 mils (10.16 mm) long. The legs 49 and 51 are each in a generally U-shaped configuration, in order to reduce cathode movement due to dimensional changes in the legs during the heating and cooling thereof. Other configurations may be used. One end of each leg 49 and 51 is slightly flattened and welded near the one end thereof to opposite sides of the sidewalls of the body 47. Each leg 49 and 51 is welded near its other end near the top of the studs 45 and 46 respectively. Each stud 45 and 46 supports an eyelet 53 and 55 respectively which shields the ceramic base 41 from material which is volatilized from the body 47 and the legs 49 and 51. The studs 45 and 46 serve also as connection means to a source of voltage by the extended ends thereof, which are connected to two of the stem leads 25.

To operate the tube 11, the usual voltages are applied to all of the tube components in the usual way, with the exception of the heater-cathode assembly. For the heater-cathode assembly, a voltage is applied to produce a current flow to generate sufficient heat in the legs to heat the body 47 to the desired operating temperature. The amount of electric power dissipated in the legs and body determines the temperature that can be reached and maintained. For the structure of the above-described example, with about 2.0 amperes of current flow through the legs, a body temperature of about 1450°K is reached in about 6 seconds, and that temperature is maintained with about 2.1 watts of power dissipation. The legs 49 and 51 are about 150° to 200°K hotter than the body 47. The saturation current density of electron emission from a type M cathode at 1450°K is about 16 amperes/cm$^2$. The resistance of the legs is calculated to be about 0.5 ohm and the resistance of the body is calculated to be about $7 \times 10^{-4}$ ohms at an operating temperature of the body of 1450°C.

In a series of experiments using structures with different leg lengths and passing different amounts of current through these structures, it has been shown that there is an optimum leg length for each different body temperature. Analysis has shown that, although the body 47 is part of the heater circuit, very little joule heat is generated in the body 47. Instead, substantially all of the heat is generated in the legs 49 and 51 due to the much higher resistance of the legs as compared to the body 47. This is achieved by providing current paths which are much longer in lengths and much smaller in cross sections in the legs than in the body. Heat generated in the legs passes by thermal conduction to the body, passes by thermal conduction to the studs 45 and 46, and is radiated from the legs.

Figure 4:
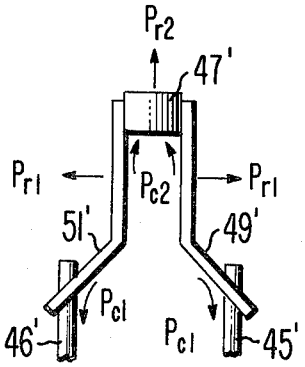
FIG. 4 is an elevation of a heater-cathode assembly shown schematically for explanatory purposes.
Figure 5:
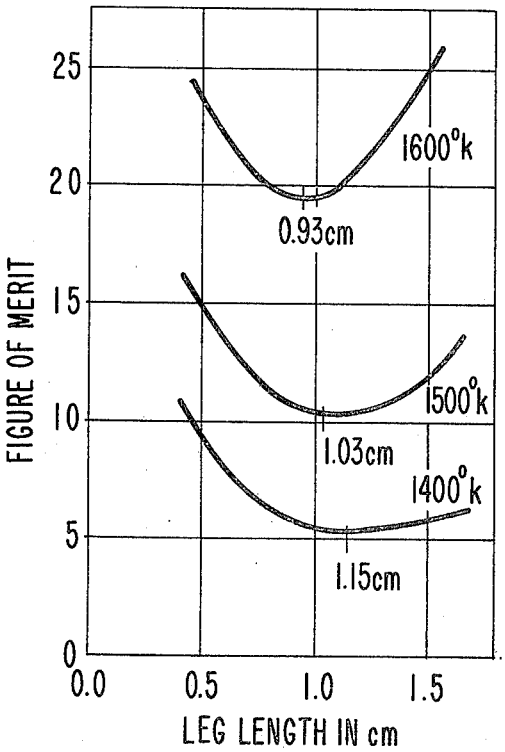
FIG. 5 is a graph showing the criticality of leg length in the heater-cathode assembly of FIG. 2.

Using the model shown in FIG. 4, with similar reference numerals as in FIG. 3, the total power P used by the structure divides into three parts, one part passes to the body 47' as $P_{c2}$, another part passes to the studs 45' and 46' as $P_{c1}$, and still another part is radiated from the legs 49' and 51' as $P_{r1}$. Substantially all of the power $P_{c2}$ passing to the body 47 is radiated therefrom as $P_{r2}$. Thus, $$P = I^2R = P_{c2} + P_{r1} + P_{c1},$$

where I is the current and R is the total resistance of the legs 49' and 51' and the body 47. Since $P_{c2}$ is substantially entirely dissipated as radiation as $P_{r2}$, it is apparent that reduced radiation from the body 47' will reduce the power dissipation. The value $P_{r1}$ is a radiation loss from the legs 49' and 51'. Radiation losses are reduced by reducing the surface area for radiation. In the claimed device, radiation losses are reduced by reducing the surface area of the body 47 and of the legs 49 and 51. This is contrary to prior devices which employ structures with relatively larger radiating surface areas. Also, the leg lengths should be long enough to overcome the conduction loss of heat $P_{c1}$ down the studs 45 and 46, but, the leg length should not be so long as to increase the leg surface excessively. It can be shown that the total power consumed increases with increased body temperature and with increased leg length (keeping the body temperature constant). Current and $P_{c1}$ decrease with increasing leg length and reach a constant value for large leg lengths at constant body temperatures. Thus, as shown in FIG. 5, there is an optimum leg length which varies with body temperature, the optimum length being more critical with higher operating temperatures. The ordinate in FIG. 5 is a figure of merit M, wherein M equals $I^2 \times P \times P_{c1}$, and the lower the value of M, the more practical the device.

By properly choosing length and diameter of the legs as well as height and diameter of the body, heater-cathode assemblies can be provided which exhibit relatively fast heating-up times (less than 10 seconds) and relatively low power dissipations. These characteristics are achieved by reducing the surface area and mass of the assembly. These characteristics can be realized with no change in the amount of emissive material in the body.

the novel heater-cathode assembly is significant for its simplicity in structure since all that is required is an electrically-conducting matrix-cathode body, two electrically-resistive legs attached to the body, and connection means for producing a current flow in the legs and body. No sheaths, shields, coatings or containers are required or desired. Such passive structures add to the bulk, mass and radiating surface of the assembly. Furthermore, the matrix body and the legs should have shapes which have minimal surface areas and which entail relatively low costs for material and fabrication. Such shapes are substantially cylindrical, circular, or spherical, which are commercially available and are easily produced.

The legs should exhibit at least one hundred times, and preferably five hundred to one thousand times, more resistance to current flow than does the body. Since the legs and the matrix of the body may be of the same or similar refractory metal, the different resistances thereof are not achieved solely by providing different resistivities in the respective parts. Instead, the different current-carrying lengths and cross-sectional areas of the legs and the body provide most of the required differences in resistances. In the example of FIG. 2, the legs are about 18 times longer than the body and about 1/40 of the cross-sectional area of the body at the largest cross section along the current path. Thus, the legs have more than 700 times more resistance than the body. More than 98 percent of the power dissipated by the body is generated in the legs and conducted to the body.

Since the matrix body is not covered, it might be thought that electron emission would occur in all directions into the grid electrode. However, in normal operation the grid electrode is biased negatively with respect to the body, thereby preventing electron emission from the body surfaces except in a very small area of the end wall of the body 47 opposite the aperture 37, where a positive field from the adjacent electrode or grid extends in through the aperture 37 to the surface of the body 47.

A further alternative structure is similar to that described above except that electrons form the directly-heated cathode are employed as an auxiliary cathode to heat another main cathode. Electrons from the directly-heated auxiliary cathode bombard the other main cathode 47, thereby providing the required heating. Although this alternative structure has greater bulk and mass than the preferred structure, the combination can be power efficient, can exhibit a fast heating-up time, and the signal voltage can be isolated from the heater voltage applied to the auxiliary cathode.

I claim:

1. An electron device comprising an evacuated envelope and means for producing an electron emission in said envelope, said means comprising a. a porous electrically-conducting body having electron-emission material in the pores thereof, b. at least two electrically-resistive legs attached directly to spaced positions on said body and c. connection means for producing a current flow through said body and said legs.

2. The device defined in claim 1 wherein the sum of the resistances of said legs is at least one hundred times greater than the resistance of said body.

3. The device defined in claim 1 wherein the sum of the resistances of said legs is about 500 to 1000 times greater than the resistance of said body.

4. The device defined in claim 1 wherein the current paths in said legs have a substantially smaller cross section than the current path in said body whereby only a small proportion of the total resistance to said current flow through said device is presented by said body.

5. The device defined in claim 1 wherein at least 98 percent of the power dissipated by the body is generated in the legs and conducted to the body.

6. The device defined in claim 1 wherein said legs have a substantially circular cross section.

7. The device defined in claim 6 wherein said body has a substantially cylindrical shape and said legs are connected to spaced positions on the sidewalls thereof.

8. The device defined in claim 6 wherein said body has a substantially spherical shape.

9. The device defined in claim 6 wherein the legs are of such lengths as to provide during operation substantially minimal power losses due to the combination of thermal conduction of heat into the connection means and radiation from the surfaces of said legs.

10. The device defined in claim 6 wherein the legs are of such lengths as to provide during operation a substantially minimal figure of merit M where $$M \text{ equals } I^2 \times P \times P_{c1}$$

and

I equals the current passing through the device,

P equals the total power used by the device, $P_{c1}$ equals the heat passing from the legs to the connection means by thermal conduction.

* * * * *

UNITED STATES PATENT OFFICE

CERTIFICATE OF CORRECTION

PATENT NO. : 3,983,443

DATED : September 28, 1976

INVENTOR(S) : Horst Ernst Paul Schade

It is certified that error appears in the above-identified patent and that said Letters Patent are hereby corrected as shown below:

| | |
|---|---|
| column 1, line 49 | change "also mechanical" to --also provide mechanical-- |
| column 3, line 12 | enclose "U-shaped" in quotes |
| column 4, line 40 | change "the" to --The-- |
| column 5, line 15 | change "form" to --from-- |

Signed and Sealed this

Eighth Day of February 1977

[SEAL]

*Attest:*

RUTH C. MASON
*Attesting Officer*

C. MARSHALL DANN
*Commissioner of Patents and Trademarks*